US007231881B2

(12) United States Patent
Nelson

(10) Patent No.: US 7,231,881 B2
(45) Date of Patent: Jun. 19, 2007

(54) DEHUMIDIFYING RADOME VENT

(75) Inventor: Larry A. Nelson, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/164,225

(22) Filed: Nov. 15, 2005

(65) Prior Publication Data

US 2007/0107647 A1 May 17, 2007

(51) Int. Cl.
*B63J 2/00* (2006.01)

(52) U.S. Cl. ..... 114/211; 114/211

(58) Field of Classification Search ..... None
See application file for complete search history.

(56) References Cited

U.S. PATENT DOCUMENTS 1,737,550 A * 12/1929 Adams ..... 114/211
2,959,785 A * 11/1960 Leatherman et al. ..... 343/872
3,911,441 A * 10/1975 Stein ..... 343/872
6,933,908 B1 * 8/2005 Mirabueno ..... 343/872

* cited by examiner

*Primary Examiner*—Lars A. Olson
(74) *Attorney, Agent, or Firm*—Ostrager Chong Flaherty & Broitman P.C.

(57) ABSTRACT

A dehumidifying radome vent in open communication between a radome and the external environment for passively ventilating and dehumidifying the radome. The dehumidifying radome vent is a duct receiving a water aerosol comprised of air and water. The duct passively decreases a flow rate of the water aerosol so as to remove water from the air and ventilate the radome. To this end, the duct defines two or more cross-sectional flow areas along a predetermined flow path. These cross-sectional flow areas include a first cross-sectional flow area and a second cross-sectional flow area. The second cross-sectional flow area is larger than the first cross-sectional flow area for passively decreasing the flow rate and dehumidifying the aerosol.

23 Claims, 2 Drawing Sheets

DEHUMIDIFYING RADOME VENT

FIELD OF THE INVENTION

The present invention relates generally to radomes, and more particularly to a dehumidifying radome vent that prevents overheating and corrosion of an antenna contained within a radome.

BACKGROUND DESCRIPTION

Satellite antenna radomes can trap moisture and heat, which may lead to the corrosion and overheating of the satellite antenna contained therein. A radome having two or more unobstructed vent openings can receive large volumes of ambient air to cool the antenna to the outside ambient temperature. However, this opening may also introduce rain and salt water, such as an aerosol, into the radome. The rain, salt water, and other condensation can produce mildew, corrosion, water accumulation, and other adverse conditions. On the other hand, a sealed radome enclosure can trap humidity, which may condense to its liquid form once the air temperature drops and thus produce the associated problems.

One known radome is a sealed enclosure with a heating element for continuously adding heat and therefore minimizing condensation. In this way, the heated enclosure decreases the variation in relative humidity, which may otherwise occur in an unheated sealed enclosure. However, this radome is power inefficient and furthermore is impractical in view of temporary out-of-use conditions that are commonly associated with maritime operations. Also, it is understood that the continuous production of heat can cause the antenna to overheat. This radome merely dissipates heat by radiation and conduction. The radome may be made of a composite (sandwich) construction to enhance stiffness and decrease radio frequency losses, which decreases thermal conductivity, making heat removal by conduction difficult (occurring largely through the base by conduction).

It would, therefore, be highly desirable to provide a dehumidifying radome vent that passively ventilates a radome and removes moisture without consuming power to do the same.

SUMMARY OF THE INVENTION

An embodiment of the invention is a dehumidifying radome vent in open communication between a radome and the external environment for passively ventilating and dehumidifying the radome. The dehumidifying radome vent is a duct receiving a water aerosol comprised of air and water. The duct passively decreases a flow rate of the water aerosol so as to remove water from the air and ventilate the radome. To this end, the duct defines two or more cross-sectional flow areas along a predetermined flow path. These cross-sectional flow areas include a first cross-sectional flow area and a second cross-sectional flow area. The second cross-sectional flow area is larger than the first cross-sectional flow area for passively decreasing the flow rate and dehumidifying the aerosol.

One advantage of the claimed invention is that a dehumidifying radome vent is provided that ventilates a radome with substantially large volumes of ambient air and therefore increases the durability of an antenna contained therein for use under hot and/or humid conditions.

Another advantage of the claimed invention is that a dehumidifying radome vent is provided that prevents water from entering a radome and thus decreases corrosion of the antenna.

Yet another advantage of the claimed invention is that a dehumidifying radome vent is provided that passively dehumidifies and ventilates a radome and therefore conserves energy and eliminates costs associated therewith.

Still another advantage of the claimed invention is that a dehumidifying radome vent is provided that has a simple and robust construction that can be quickly produced at significantly low costs.

The features, functions, and advantages can be achieved independently and in various embodiments of the present invention or may be combined in yet other embodiments.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Figure 1:
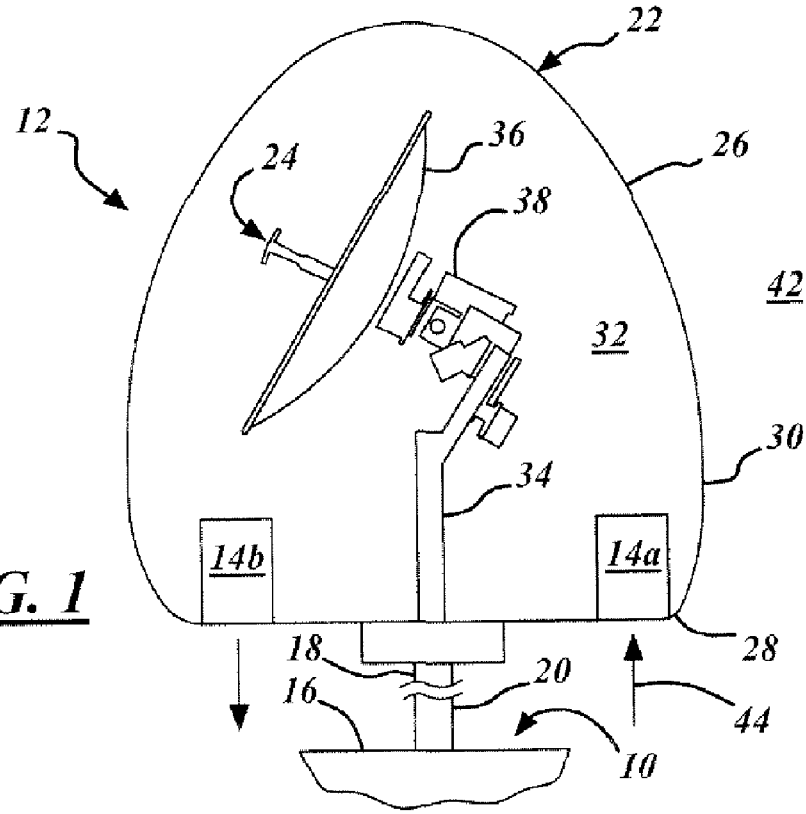
FIG. 1 is schematic view of a maritime vessel having a satellite antenna assembly with two dehumidifying radome vents, according to one advantageous embodiment of the claimed invention.

In the following figures, the same reference numerals are used to identify the same or similar components in the various representative views.

The present invention is particularly suited for a dehumidifying radome vent for a radome containing a small Ku band satellite antenna for a maritime vessel. Accordingly, the embodiments described herein employ features where the context permits, e.g. when a specific result or advantage of the claimed invention is desired. However, it is contemplated that the dehumidifying radome vent can instead be utilized for other suitable enclosures, which surround a variety of other antenna or other objects and are mounted to other vehicles, building structures, or land-based towers as desired. In this respect, a variety of other embodiments are contemplated having different combinations of the described features, having features other than those described herein, or even lacking one or more of those features.

Referring to FIG. 1, there is illustrated a schematic representation of a maritime vessel 10 having a satellite antenna assembly 12 with two or more dehumidifying radome vents 14*a*, 14*b* ("vents"). Specifically, the maritime vessel 10 has a deck 16 and a mast 18 extending upward from the deck 16. The mast 18 has an elevated portion 20 with the satellite antenna assembly 12 mounted thereon.

In this embodiment, the satellite antenna assembly 12 is comprised of a radome 22, a satellite antenna 24, and two vents 14*a*, 14*b*. It is understood that the satellite antenna assembly 12 can have more or less than two vents 14*a*, 14*b*.

The radome 22 has a top end portion 26, a bottom end portion 28, and a sidewall portion 30 therebetween, which define an antenna chamber 32. The bottom end portion 28 is attached to the elevated portion 20 of the mast 18. Preferably, the bottom end portion 28 has two or more vents 14*a*, 14*b* diametrically positioned therein. Accordingly, pressure gradients, such as wind conditions in one direction, force ambient air into the radome 22 through one vent 14*a* and out the radome 22 through the other vent 14*b*. Put another way, the radome 22 preferably has a sufficient number of vents 14*a*, 14*b* in a predetermined configuration for providing at least one inlet vent 14*a*, at least one outlet vent 14*b*, and the flow patterns associated therewith.

The satellite antenna 24 has a lower end portion 34 and an upper end portion 36. The lower end portion 34 of the antenna 24 is mounted to the elevated portion 20 of the mast 18 within the antenna chamber 32 of the radome 22. The upper end portion 36 of the antenna has one or more electrical drive motors 38 substantially therein and distal to the vents 14*a*, 14*b*. Thus, to the extent that moisture is within the radome 22 and condensation occurs therein, water travels downward and away from the electrical drive motors 38.

As detailed below, the vents 14*a*, 14*b* passively dehumidify and direct fresh ambient air through the radome 22. It will be appreciated that air is circulated through the radome 22 when the pressure gradient across the respective vents 14*a*, 14*b* is greater than zero. Such a pressure difference typically occurs naturally due to the daily variation in position of the sun and by wind pressure gradients. However, it is also contemplated that the vents 14*a*, 14*b* can also be used in conjunction with fans or other forced air systems.

Figure 2:
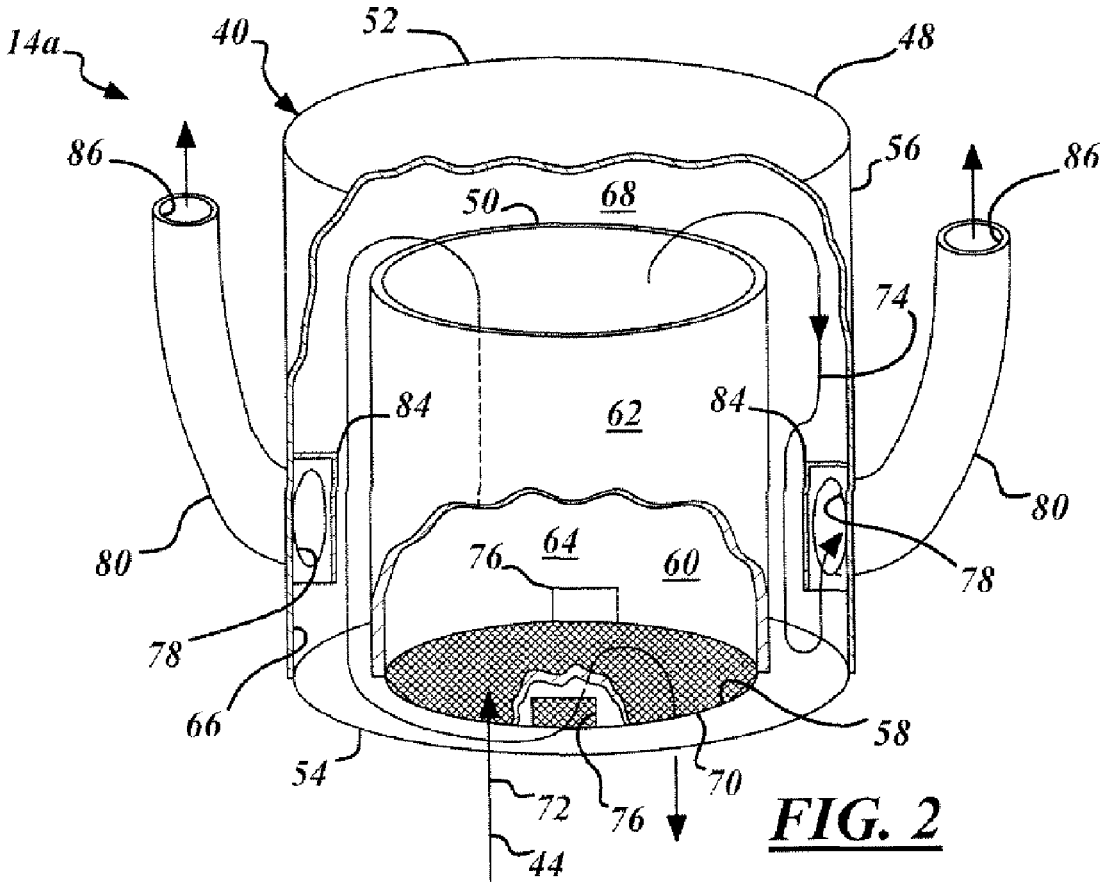
FIG. 2 is a partially cutaway perspective view of one of the dehumidifying radome vents shown in FIG. 1.

With attention to FIG. 2, there is shown a partially cutaway view of the vent 14*a*, according to one advantageous embodiment of the claimed invention. In this embodiment, both vents 14*a*, 14*b* have the same construction. In this respect, it is contemplated that vent 14*b* has the same construction as vent 14*a* detailed below.

The vent 14*a* is comprised of a duct 40 in open communication between the antenna chamber 32 of the radome 22 (shown in FIG. 1) and the external environment 42 (shown in FIG. 1). This duct 40 is adapted for receiving a water aerosol 44 when a predetermined pressure gradient exists between the antenna chamber 32 and the ambient environment 46. It is understood that a water aerosol 44 is a cloud of fine liquid particles, e.g. a fine spray of salt water in a maritime environment.

The vents 14*a*, 14*b* use the difference in masses between air and water to separate air from water in the aerosol 44. Namely, the vents 14*a*, 14*b* decrease or stagnate the flow of the aerosol 44 to prevent air from carrying the fine water droplets via convective action. The vents 14*a*, 14*b* also direct the flow generally against gravitational force and/or centrifugal force for removing additional water droplets therefrom. Finally, the vents 14*a*, 14*b* change the flow direction to remove the heavier water droplets from the air by the inertia of the droplets and their adhesion to the duct 40.

The duct 40 passively decreases a flow rate of the water aerosol 40 for removing water from the air and ventilating the radome 22. To that end, as detailed below, the duct 40 defines two or more cross-sectional flow areas of the duct 40 along a predetermined flow path.

In particular, the duct 40 includes an enclosure 48 and an open-ended intake cylinder 50. In this embodiment, the enclosure 48 is a tubular chamber with a top portion 52, a bottom portion 54, and a sidewall structure 56. The bottom portion 54 of the enclosure 48 has an intake port 58 with the intake cylinder 50 extending therefrom. The intake cylinder 50 has an inner surface 60 and an outer surface 62. The inner surface 60 of the intake cylinder 50 defines a first cross-sectional flow area 64 of the duct 40 ("first flow area"). The outer surface 62 of the intake cylinder 50 and an internal surface 66 of the enclosure 48 define a second cross-sectional flow area 68 of the duct 40 ("second flow area"). The second flow area 68 is larger than the first flow area 64 for passively decreasing the flow rate of the aerosol 44. Also, as explained above, the slower flow rate decreases the convective action that otherwise suspends the water droplets in the air.

It will be appreciated that decreasing the flow rate increases the tendency of water droplets to be removed from the aerosol 44. In particular, a generally slower flow rate increases the opportunity for the droplets to combine with other droplets, fall from the aerosol 44, collide into the internal surface 66 of the enclosure 48, or otherwise become removed from the aerosol 42.

The intake cylinder 50 has a screen member 70 extending across its width for contacting water droplets in the aerosol 44, removing those droplets from the aerosol 42, and conveying air through the intake cylinder 50.

Also, the intake cylinder 50 has a predetermined height for removing a predetermined amount of water from the aerosol. It will be appreciated that increasing the height of the intake cylinder 50 increases the distance that the water aerosol 44 travels upward against gravity and therefore increases the amount of water droplets falling from the aerosol 44. For instance, relatively heavy water droplets in a light wind can fall from the aerosol 44 down through the intake cylinder 50 and out the intake port 58. In addition, it is also understood that the falling water droplets further decrease the flow rate of the aerosol 44 into the enclosure 48. The intake cylinder 50 is sized for removing a predetermined amount of water from the air under predetermined flow conditions.

The duct 40 is also configured for redirecting air to remove additional water from the water aerosol 44. In the embodiment shown in FIG. 2, the intake cylinder 50 has a first axial direction 72 for directing the aerosol 44, and the enclosure 48 has a second axial direction 74 for redirecting the aerosol 42. The second axial direction 74 is offset from the first axial direction 72 by 180 degrees for redirecting the aerosol 44 generally downward and around the intake cylinder 50. To that end, the top portion 52 and the sidewall structure 56 of the enclosure 48 force the aerosol 44 downward. In this regard, water droplets in the aerosol 44 contact the internal surface 66 of the top portion 52 for the enclosure 48 and thus are removed from the aerosol 44. In addition, it will be appreciated that redirecting the aerosol 42 assists in passively decreasing the flow rate. It is contemplated that the second axial direction 74 can be offset from the first axial direction 72 by a variety of other suitable predetermined offset angles.

Also, in this embodiment, the intake cylinder 50 has a pair of drainage holes 76 for draining water from the enclosure 48. These drainage holes 76 are adjacent to the bottom portion 54 of the enclosure 48. It is understood that the intake cylinder 50 can have more or less than two (2) drainage holes 76 in various other suitable locations as desired.

The sidewall structure 56 of the enclosure 48 has a pair of exhaust ports 78 diametrically formed therein with a pair of exhaust cylinders 80 extending from those ports 78. It is contemplated that the vent 14*a* can have more or less than two (2) exhaust ports 78 and exhaust ducts 82. The exhaust ports 78 are sufficiently covered by a pair of exhaust cover plates 84, which are attached to the sidewall structure 56, so as to redirect the aerosol 44 upward through the respective exhaust port 78 and the exhaust duct 82. Accordingly, similar to the intake cylinder 50 described above, gravitational force removes additional water droplets from the aerosol 44 as the aerosol 44 travels up the exhaust cylinder 80. The exhaust ducts 82 have an interior surface 86 directing water into the enclosure 48 and through the drainage holes 76. Also, the exhaust ports 78 preferably are positioned on the sidewall structure 56 sufficiently adjacent to the bottom portion 54 of the enclosure 48 for receiving the aerosol 44 as it is redirected upward by the bottom portion 54 of the enclosure 48. In this embodiment, the exhaust ports 78 and exhaust cylinders 80 are positioned radially perpendicular to the drainage holes 76 in the intake cylinder 50.

It will be appreciated that this vent 14*a* has an efficiently packaged construction and therefore is beneficial for increasing the available space within the radome 22. It is contemplated that the vent 14*a* can have a variety of other suitable constructions.

Figure 3:
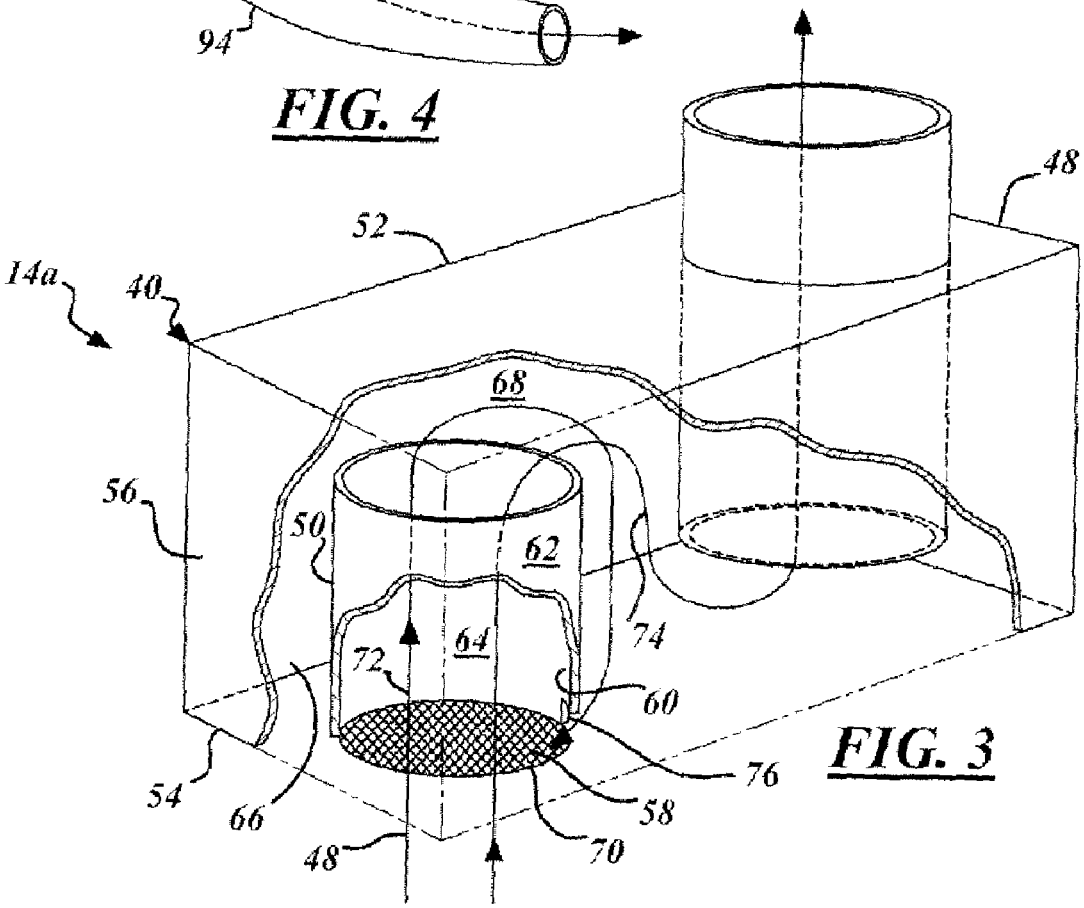
FIG. 3 is a partially cutaway perspective view of one of the dehumidifying radome vents shown in FIG. 1, according to an alternative embodiment of the claimed invention.

For example, referring to the embodiment shown in FIG. 3, the enclosure 48 has an elongated box construction. In this embodiment, the enclosure 48 and the intake cylinder 50 define a second flow area 68 that is substantially larger than the first flow area 64 and therefore substantially decreases the flow rate of the aerosol 44 through the duct 40. In this way, a significant amount of water is removed from the aerosol 44. This construction is beneficial for a radome, which has a relatively large amount of available space and requires a generally low volume of ventilation.

Also, in this embodiment, the top portion 52 of the enclosure 48 has the exhaust port 78 with the exhaust cylinder 80 extending therethrough. The bottom portion 54 of the enclosure 48 is sloped downward toward the drainage hole 76 in the intake cylinder 50. However, it is also contemplated that the bottom portion 54 can instead be level and/or have one or more drainage holes 76.

Moreover, the first axial direction 72 of the intake cylinder 50 is generally perpendicular to the second axial direction 74 of the enclosure 48. In this respect, it will be appreciated that the duct 40 can be adapted for redirecting the flow pattern in a variety of suitable ways to remove various sized water droplets within various packaging requirements and under various pressure gradients.

Figure 4:
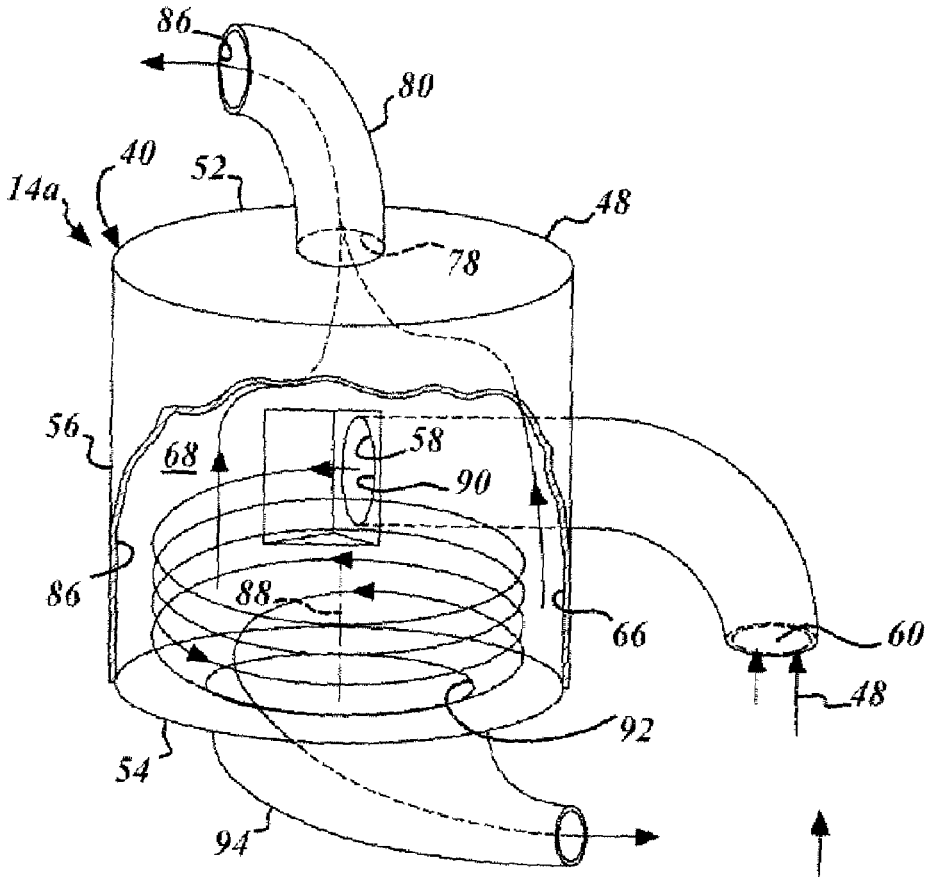
FIG. 4 is a partially cutaway perspective view of one of the dehumidifying radome vents shown in FIG. 1, according to still another alternative embodiment of the claimed invention.

With attention now to the embodiment shown in FIG. 4, the intake cylinder 50 defines a tubular chamber with a longitudinal axis 88 for continuously redirecting the flow of aerosol 44 in a spiral path along that axis 88. In this regard, the internal surface 86 of the sidewall structure 56 substantially increases the number of times that the inertia of the water droplets carries those droplets into contact with the enclosure 48 and provides a centrifugal force acting on the water droplets in addition to gravitational force and thus removes the droplets from the aerosol 44. To this end, the intake cylinder 50 is sufficiently aligned with the internal surface 66 of the enclosure 48 for directing the aerosol 44 into the enclosure 48 along the cylindrical internal surface 66. Also in this embodiment, the intake cylinder 50 and the enclosure 48 have an intake cover plate 84 aligned therebetween for assisting in directing the flow from the intake cylinder 50 along the internal surface 66 of the enclosure 48.

The intake cylinder 50 and the exhaust cylinder 80 have arcuate constructions for redirecting the flow of aerosol 44. It will be appreciated that a finite element analysis of these arcuate cylinders 50, 80 establishes a series of axial directions and offset angles for directing the flow of aerosol within each cylinder 50, 80.

Also in this embodiment, the top portion 52 of the cylinder 80 has the exhaust port 78 with the exhaust cylinder 80 extending upward therefrom. Further, the sidewall structure 56 of the enclosure 48 has the inlet port 90 with the intake cylinder 50 extending downward therefrom.

The bottom portion of the enclosure 48 has a drainage port 92 with a drainage cylinder 94 extending therefrom. The drainage cylinder 94 decreases in diameter from the drainage port 92. Accordingly, to the extent that an aerosol 44 enters the enclosure 48 through the drainage port 92, the flow rate of the aerosol 44 decreases toward the enclosure 48.

While particular embodiments of the invention have been shown and described, numerous variations and alternate embodiments will occur to those skilled in the art. Accordingly, it is intended that the invention be limited only in terms of the appended claims.

What is claimed is:

1. A dehumidifying radome vent comprising:

a duct receiving a water aerosol comprised of air and water, said duct comprising an enclosure, an intake cylinder, an exhaust cylinder and at least one drainage cylinder, wherein said intake cylinder, said exhaust cylinder and said at least one drainage cylinder are in open communication with said enclosure, said enclosure defining an intake port with said intake cylinder extending therefrom, an exhaust port with said exhaust cylinder extending therefrom for directing air into said radome and at least one drainage port with said at least one drainage cylinder extending therefrom for draining water from said enclosure;

said duct passively decreasing a flow rate of said water aerosol for separating air from said water aerosol and ventilating a radome;

said duct defining at least two cross-sectional flow areas along a predetermined flow path;

said at least two cross-sectional flow areas comprising a first cross-sectional flow area and a second cross-sectional flow area;

said second cross-sectional flow area larger than said first cross-sectional flow area and passively decreasing said flow rate;

said first cross-sectional flow area defined by an inner surface of said intake cylinder;

said second cross-sectional flow area defined between an outer surface of said intake cylinder and an internal surface of said enclosure.

2. The dehumidifying radome vent recited in claim 1 wherein at least one of said enclosure and said intake cylinder has a baffle member attached thereto for decreasing said flow rate of said aerosol.

3. A dehumidifying radome vent comprising:

a duct receiving a water aerosol comprised of air and water, said duct comprising an enclosure and an intake cylinder in open communication with said enclosure;

said enclosure having a top portion, a bottom portion, and a sidewall structure therebetween with at least one of said bottom portion and said sidewall structure defining an intake port with said intake cylinder extending therefrom;

said duct passively decreasing a flow rate of said water aerosol for separating air from said water aerosol and ventilating a radome;

said duct defining at least two cross-sectional flow areas along a predetermined flow path;

said at least two cross-sectional flow areas comprising a first cross-sectional flow area and a second cross-sectional flow area;

said second cross-sectional flow area larger than said first cross-sectional flow area and passively decreasing said flow rate;

said first cross-sectional flow area of said duct defined by an inner surface of said intake cylinder;

said second cross-sectional flow area of said duct defined between an outer surface of said intake cylinder and an internal surface of said enclosure.

4. The dehumidifying radome vent recited in claim 3 wherein at least one of said top portion and said sidewall structure of said enclosure defines an exhaust port for directing air into said radome.

5. The dehumidifying radome vent recited in claim 4 wherein said duct further comprises:

an exhaust cylinder extending from said exhaust port of said enclosure and passively directing air from said enclosure into said radome.

6. The dehumidifying radome vent recited in claim 5 wherein said exhaust cylinder extends upward from said enclosure and has an internal surface directing water downward into said enclosure.

7. The dehumidifying radome vent recited in claim 5 wherein said bottom portion of said enclosure defines at least one drainage port with at least one drainage cylinder extending therefrom.

8. The dehumidifying radome vent recited in claim 3 wherein said intake cylinder has at least one drainage hole draining water from said enclosure and through said intake cylinder.

9. The dehumidifying radome vent recited in claim 8 wherein said drainage hole in said intake cylinder has a pair of drainage holes radially perpendicular to a pair of exhaust ports formed in said enclosure.

10. The dehumidifying radome vent recited in claim 3, wherein at least one of said enclosure and said intake cylinder has a baffle member attached thereto for decreasing said flow rate of said aerosol, wherein said baffle member comprises at least one of:

a screen member extending across said intake cylinder;

an intake cover plate aligned with an internal surface of said enclosure for directing said water aerosol in a substantially spiral path; and an exhaust cover plate attached to said enclosure for directing said water aerosol upward from said enclosure through an exhaust port formed in said enclosure.

11. A satellite antenna radome assembly comprising:

a radome defining an antenna chamber;

a satellite antenna within said antenna chamber; and at least one of said dehumidifying radome vents recited in claim 3 and integrated within said dome.

12. The satellite antenna radome assembly recited in claim 11 wherein said radome has a top end portion and a bottom end portion with said at least one dehumidifying radome vent integrated with said bottom end portion.

13. The satellite antenna radome assembly recited in claim 11 wherein said satellite antenna has an upper end portion and a lower end portion with an antenna drive mechanism located substantially in said upper end portion.

14. The satellite antenna radome assembly recited in claim 11 wherein said at least one dehumidifying radome vent comprises at least one radome inlet vent and at least one radome outlet vent integrated in a bottom floor portion of said radome.

15. A maritime vessel comprising:

a deck;

a mast extending from said deck; and said satellite antenna radome assembly recited in claim 11 and mounted to said mast.

16. A dehumidifying radome vent comprising:

a duct receiving a water aerosol comprised of air and water, said duct comprising an enclosure, an intake cylinder, an exhaust cylinder and at least one drainage cylinder, wherein said intake cylinder, said exhaust cylinder and said at least one drainage cylinder are in open communication with said enclosure, said enclosure defining an intake port with said intake cylinder extending therefrom, an exhaust port with said exhaust cylinder extending therefrom for directing air into said radome and at least one drainage port with said at least one drainage cylinder extending therefrom for draining water from said enclosure;

said duct passively decreasing a flow rate of said water aerosol for separating air from said water aerosol and ventilating a radome;

said duct having at least two length portions with at least two axial directions defining a predetermined flow path;

said at least two length portions comprising a first length portion with a first axial direction and a second length portion with a second axial direction;

said second axial direction offset from said first axial direction by a predetermined offset angle for redirecting said water aerosol and passively decreasing said flow rate.

17. The dehumidifying radome vent recited in claim 16 wherein said intake cylinder has an arcuate construction defining said at least two axial directions for redirecting said flow.

18. A dehumidifying radome vent comprising:

a duct receiving a water aerosol comprised of air and water;

said duct passively decreasing a flow rate of said water aerosol for separating air from said water aerosol and ventilating a radome;

said duct having at least two length portions with at least two axial directions defining a predetermined flow path;

said at least two length portions comprising a first length portion with a first axial direction and a second length portion with a second axial direction;

said second axial direction offset from said first axial direction by a predetermined offset angle for redirecting said water aerosol and passively decreasing said flow rate;

wherein an enclosure has a cylindrical construction with a longitudinal axis and an internal surface directing said flow in a substantially spiral path along said longitudinal axis.

19. The dehumidifying radome vent recited in claim 18 wherein an intake cylinder and said internal surface of said enclosure have a baffle member aligned therebetween for directing said flow along said internal surface and in said substantially spiral path.

20. A satellite antenna radome assembly comprising:

a radome defining an antenna chamber;

a satellite antenna within said antenna chamber; and at least one of said dehumidifying radome vents recited in claim 18 and integrated within said radome.

21. A maritime vessel comprising:

a deck;

a mast extending from said deck; and said satellite antenna radome assembly recited in claim 20 and mounted to said mast.

22. A dehumidifying radome vent comprising:

a duct receiving a water aerosol comprised of air and water;

said duct passively decreasing a flow rate of said water aerosol for separating air from said water aerosol and ventilating a radome;

said duct comprising an enclosure, an intake cylinder, an exhaust cylinder and at least one drainage cylinder, wherein said intake cylinder, said exhaust cylinder and said at least one drainage cylinder are in open communication with said enclosure, said enclosure defining an intake port with said intake cylinder extending therefrom, an exhaust port with said exhaust cylinder extending therefrom for directing air into said radome and at least one drainage port with said at least one drainage cylinder extending therefrom for draining water from said enclosure;

said enclosure having a top end portion, a bottom end portion, and a sidewall structure therebetween;

said intake cylinder extending into said enclosure by a predetermined height from said bottom end portion of said enclosure for removing a predetermined amount of water from said water aerosol;

a first cross-sectional flow area of said duct defined by an inner surface of said intake cylinder;

a second cross-sectional flow area of said duct defined by an outer surface of said intake cylinder and an internal surface of said enclosure;

said second cross-sectional flow area larger than said first cross-sectional flow area by a predetermined volume for passively decreasing said flow rate by a predetermined deceleration;

said intake cylinder having a first axial direction for directing said water aerosol;

said enclosure having a second axial direction for directing said water aerosol;

said second axial direction offset from said first axial direction by a predetermined offset angle for redirecting said water aerosol and passively decreasing said flow rate.

23. A radome assembly comprising:

a radome having an antenna chamber for containing a satellite antenna;

said radome having a top end portion, a bottom end portion, and a sidewall portion;

at least two of said dehumidifying radome vents, each of said dehumidifying radome vents comprising:

a duct receiving a water aerosol comprised of air and water;

said duct passively decreasing a flow rate of said water aerosol for separating air from said water aerosol and ventilating a radome;

said duct comprising an enclosure and an intake cylinder in open communication with said enclosure;

said enclosure having a top end portion, a bottom end portion, and a sidewall structure therebetween;

said intake cylinder extending into said enclosure by a predetermined height from said bottom end portion of said enclosure for removing a predetermined amount of water from said water aerosol;

a first cross-sectional flow area of said duct defined by an inner surface of said intake cylinder;

a second cross-sectional flow area of said duct defined by an outer surface of said intake cylinder and an internal surface of said enclosure;

said second cross-sectional flow area larger than said first cross-sectional flow area by a predetermined volume for passively decreasing said flow rate by a predetermined deceleration;

said intake cylinder having a first axial direction for directing said water aerosol;

said enclosure having a second axial direction for directing said water aerosol;

said second axial direction offset from said first axial direction by a predetermined offset angle for redirecting said water aerosol and passively decreasing said flow rate;

said at least two dehumidifying radome vents comprising at least one radome inlet vent and at least one outlet vent.

* * * * *